United States Patent [19]

Belleli

[11] 4,343,351

[45] Aug. 10, 1982

[54] COUNTERFLOW HEAT EXCHANGER

[76] Inventor: Riccardo Belleli, Viale Hermada, 13 - Mantova, Italy

[21] Appl. No.: 39,003

[22] Filed: May 14, 1979

[30] Foreign Application Priority Data

May 16, 1978 [IT] Italy ..... 23455 A/78

[51] Int. Cl.[3] ..... F28D 7/08; F28F 9/02; F22B 37/10

[52] U.S. Cl. ..... 165/81; 122/32; 165/158; 165/160; 165/163

[58] Field of Search ..... 165/163, 158, 81, 159-162; 122/32, 34

[56] References Cited

U.S. PATENT DOCUMENTS

| | | | |
|---|---|---|---|
| 3,732,922 | 5/1973 | Pouderoux | 165/163 X |
| 3,854,528 | 12/1974 | Pouderoux et al. | 165/158 |
| 4,117,885 | 10/1978 | Nickerson et al. | 165/163 X |
| 4,120,348 | 10/1978 | Pouderoux | 165/81 |
| 4,187,902 | 2/1980 | Miller, Jr. et al. | 165/158 X |

FOREIGN PATENT DOCUMENTS

| | | | |
|---|---|---|---|
| 1097551 | 7/1955 | France | 165/158 |
| 653496 | 3/1979 | U.S.S.R. | 165/163 |

*Primary Examiner*—Sheldon J. Richter
*Attorney, Agent, or Firm*—Guido Modiano; Albert Josif

[57] ABSTRACT

A counterflow heat exchanger comprises facing parallelly coaxially extending upper and lower tube plates wherebetween extends a tube nest including a plurality of tubes. The tubes, which are distributed substantially in a polar symmetry arrangement, have at one end an S-like bent portion and the thermal exchange zone defining rectilinear portion of the tube nest is enclosed within an annular interspace defined between an inner jacket and an outer shroud fixed to the tube plates.

8 Claims, 11 Drawing Figures

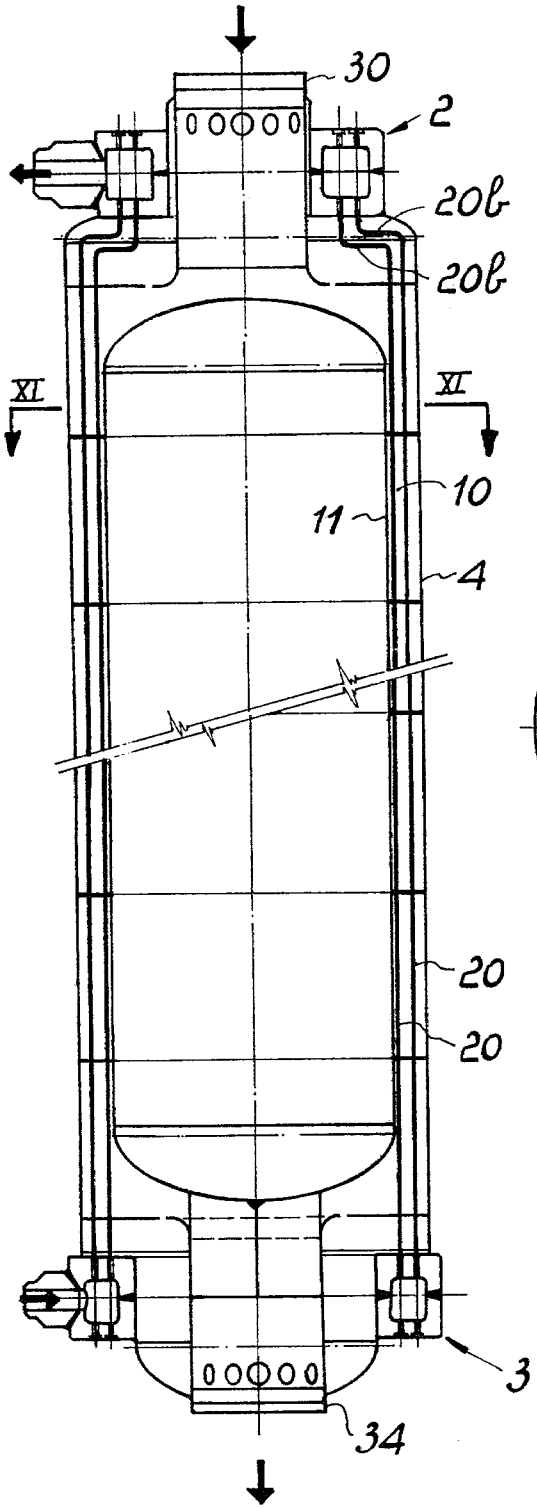
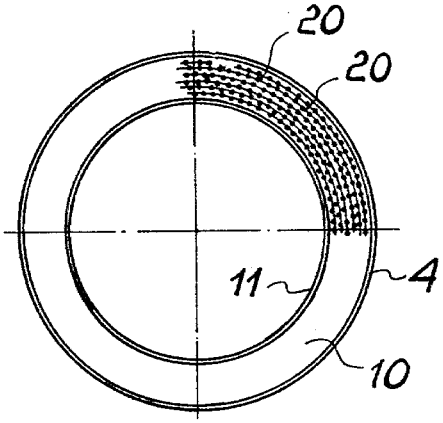
Fig. 11
Fig. 10

COUNTERFLOW HEAT EXCHANGER

BACKGROUND OF THE INVENTION

This invention relates to a counterflow heat exchanger having two fixed tube plates and a thermal exchange zone comprising substantially straight tubes, and in particular to a heat exchanger suitable for high pressure and temperature service, to be employed in either conventional or nuclear power stations, as well as in other industrial plants.

As is known, several industrial plants make use of counterflow heat exchangers which are of considerable size, and owing to the severe operating conditions encountered, expected to provide the highest and most comprehensive degree of reliability, both to avoid halting the plants, with obviously heavy consequences of an economical nature, and for inherent safety reasons. Typical examples are the steam generators using sodium as the primary fluid, which are installed at nuclear power stations of the LMFBR type.

Heretofore, such heat exchangers comprised, in the majority of cases, a pair of oppositely located tube plates, arranged to face each other at a distance apart, which are interconnected by a nest of tubes welded to the plates themselves in a manner that will be explained hereinafter, for the passage of the secondary fluid; also provided is a shroud or outer casing which connects the tube plates to each other such as to enclose the tube nest and confine the primary fluid passage zone.

The structure of such heat exchangers, as well as that of other known designs, has first of all the serious disadvantge—which affects in particular the cited steam generators using sodium as the primary fluid—of a disuniform primary fluid flow at the thermal exchange zone, which flow, at the usually circular center portion of the stream section, has a higher velocity than at the periphery thereof; this results in a non-uniform distribution of the wall temperature in the various tubes, with attendant negative consequences, particularly of a mechanical and structural nature, as the expert will readily recognize.

Also, the inlet and outlet flows of the primary fluid are imperfectly uniform, as dictated by the provision of conventional annular headers, usually arranged externally to the tube nest.

Furthermore, it is known that in high reliability heat exchangers, the best procedure currently adopted for welding the tubes to the tube plates is one selected from the IBW (Internal Bore Welding) techniques and enables the tubes to be butt welded to spigot members, purposely formed on the plates and bored to a diameter which is substantially equal to the inside diameter of the tube; more specifically, this type of weldment, which is known per se, provides for the end of the tube to be welded to fit inside a seat formed on the spigot, as prearranged on the tube plate, thereafter access is gained with a welding torch to the tube inside, at the joint area, to carry out the welding, usually without deposition of any weld material.

This type of weldment, especially in view of the severe operating conditions anticipated for the cited exchanger designs, must then be individually checked, in general by X-ray or ultrasonic inspection, to ascertain its reliability.

Now, as mentioned, in most heat exchangers of conventional design, the tube plates are arranged to face each other from a distance apart, thereby in order to allow the individual tubes which make up the nest to be installed in conformity with accepted manufacturing and inspection practices, it becomes necessary to provide one plate with bores having substantially the same size as the tube outside diameter, whereas the other plate can be prefabricated with spigots having seats adapted for convenient application of the aforementioned welding procedure.

A serious problem encountered with conventional heat exchangers of this type is that the requirement of providing one plate with bores having the same size as or a size slightly larger than the tube outside diameter makes it necessary to insert the tube end for a few millimeters inside the bore, purposely made oversize to accommodate the tube, thereby, when this tube end is welded to the tube plate, the weldment area acquires a substantially truncated cone flare out rather than being rectilinear.

The presence of this flare-out at the weldment area has first of all the disadvantage of being liable to undergo deflection and shear actions, which are technically undesirable in this type of joint, and moreover this type of weldment is difficult to X-ray, such that considerable problems are encountered during the inspection step; trouble may also arise from the fluid dynamics characteristics which result therefrom.

A further serious drawback of the heat exchangers of the type just described, as well as of other conventional such designs, resides in that for obvious reasons of construction and inspection at least part of the outer casing or shroud must be attached to the tube plates after welding the tube nest to the plates, thereby considerable difficulty is experienced when it comes to X-raying the shroud weldments, while it is impossible to reweld the weldments because no access can be had to the inside. It should be further added to the foregoing that when the shroud is connected to the tube plates after the installation of the tube nest, any heat treatment of the welded areas of the shroud becomes extremely difficult to carry out.

Provision may be mde in the heat exchangers of the type described above for the presence of an expansion joint in the shroud effective to accommodate thermal expansion differentials between the tube nest and shroud; while in the latter case there still exists the possibility of the whole tube nest expanding, any expansion differentials, as originating from various causes, between the tubes are nevertheless prevented, an example of such causes being a different flow distribution from one tube to another. These expansion differentials unavoidably generate tensions that concentrate at the weldment areas of the tubes to the tube plates, which brings about obvious risks and trouble especially with joints of conventional type, where as mentioned deflection and shear stresses are induced.

Still another drawback of almost all the known types, and one which is more markedly evident when high pressures are involved, is that the forged stock used for forming the tube plates have a large mass, which adds complications of mechanical, thermal, and metallurgical natures. Also considerable is the difficulty of assembling the tube nest.

SUMMARY OF THE INVENTION

Thus, the instant invention sets out to provide a counterflow heat exchanger having two fixed tube plates and a thermal exchange zone comprising substantially straight tubes, which is so constructed as to allow the application of IBW techniques to the butt welding of the ends of the tube nest onto spigots formed on both tube plates and having a bore with substantially the same diameter as the tube inside diameter.

Within that general aim, it is possible to arrange that the heat exchanger according to the invention, while having both its tube plates fixed, allows for a different expansion rate of the tubes in the tube nest, and above all for that expansion differential among the tubes to occur without inducing deflection and shear stresses in either weldments of each tube to the tube plates.

It is further possible to arrange for the provision of weldment areas between the tubes and plates, as well as between the shroud and plates, which can be readily X-rayed, and that, as relates to the tube-to-plate weldments, ultrasonic inspection be also facilitated, thus ensuring the highest degree of reliability in such joints.

Moreover, it is further possible, according to this invention, that a heat exchanger be provided wherein the tubes wherethrough the secondary fluid is circulated are arranged in polar symmetry, namely a symmetry situation which remains substantially the same in all the planes making up the star about the longitudinal axis of the exchanger, or in other words, uniformly distributed in annulus, such that said tubes are uniformly enveloped in the stream of primary fluid. A first advantage of the tube arrangement described above is that the circulation of the primary fluid through a duct having an annulus cross-sectional shape occurs with a better distribution that is obtainable with conventional heat exchangers, wherein the stream section of said fluid occupies the entire circular cross-section of the exchanger, with attendant lack of uniformity between the central portion and the portions proximate to the walls; a polar symmetry distribution is also achieved for the thermal gradients in the exchanger structure, thus achieving a condition of substantial identity in the distribution of temperatures in each axial section, which brings about obvious and important advantages as relates to the distribution of the mechanical stresses resulting in said structure.

It is further possible to arrange for the provision, in this invention, of an optimal flow uniformity for the primary fluid at the tube nest inlet and outlet ends, by using a simpler structure than the current one which comprises annular headers, usually located on the outside of the tube nest.

It is further possible to arrange that this invention provides a structure wherein all of the weldment areas of the tubes to the tube plates are only subjected to substantially tensile or compressive stresses, with the resultant advantage that no deflection and shear stresses are induced therein which are technically undesirable. Moreover, probes can be easily inserted for periodically checking the tube-to-plate weldments, without prior disassembly of the apparatus, which operation would evidently be a tedious and time-consuming one, and accordingly very expensive.

It is further possible, in this invention, to arrange for the utilization, in forming the tube plates, of reduced mass forgings, as this brings about several advantages, the first whereof is the capability of achieving good mechanical properties in the material, which would instead be difficult to accomplish with large mass forgings, as is the case with most conventional designs; of particular usefulness is then the adoption of small mass and thickness forgings when the operating conditions involve high thermal gradients between the primary and secondary fluids, specially fast thermal transients, and the primary fluid has high thermal conductivity, which conditions may all be encountered in steam generators using sodium as the primary fluid.

According to one aspect of the present invention, there is provided a counterflow heat exchanger having two fixed tube plates, characterized in that it comprises an upper tube plate and a lower tube plate arranged to face each other in parallel and coaxial relationship and having different mean diameters of the bored areas, between said upper and lower tube plates there extending a tube nest including a plurality of tubes, said tubes being connected to said tube plates and distributed substantially in a polar symmetry arrangement and having at one end an S-like bent portion, the rectilinear portion of said tube nest substantially comprising the thermal exchange zone being enclosed with substantially uniform distribution within an annular interspace defined between an inner jacket and an outer shroud attached to said tube plates.

BRIEF DESCRIPTION OF THE DRAWINGS

Further features and advantages will be more clearly apparent from the description of two preferred, though not limitative, embodiments of a counterflow heat exchanger having two fixed tube plates, e.g. suitable for use as a steam generator in nuclear power stations utilizing liquid sodium as the primary fluid, illustrated by way of example only in the accompanying drawings, where:

FIG. 10 shows schematically in longitudinal section the heat exchanger according to a second embodiment of this invention; and FIG. 11 is a schematical sectional view taken along the line XI—XI of FIG. 10.

DESCRIPTION OF THE PREFERRED EMBODIMENTS

Figure 1:
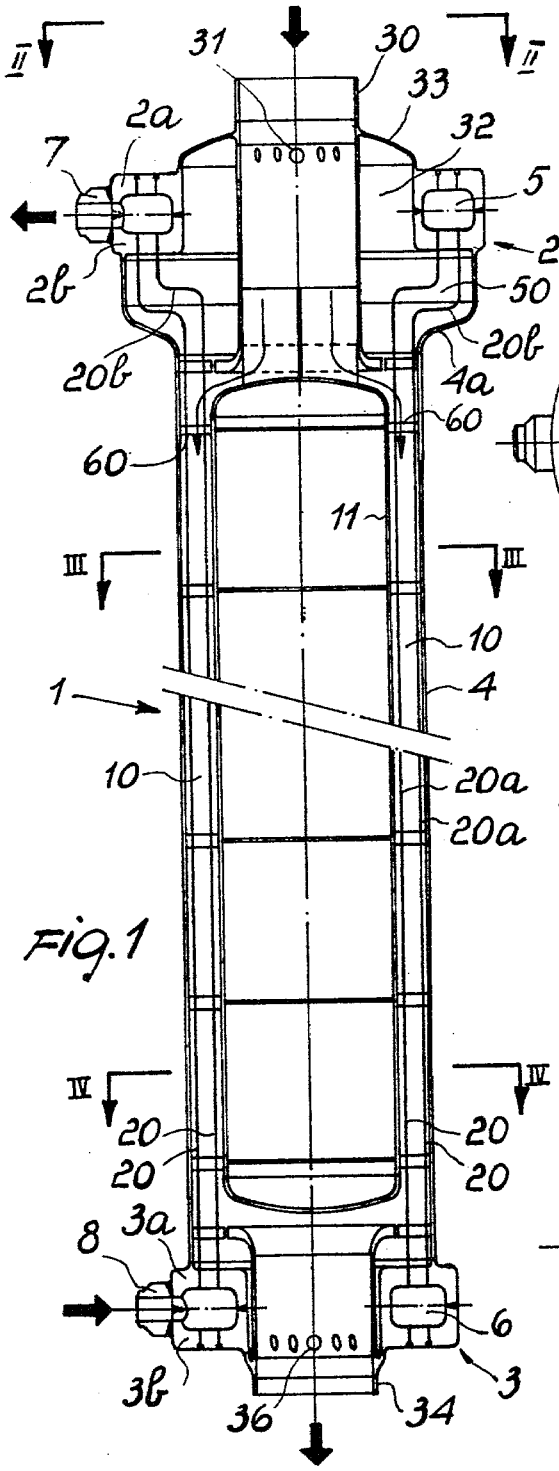
FIG. 1 is a schematical longitudinal section of the heat exchanger according to a first embodiment of the invention.
Figure 2:
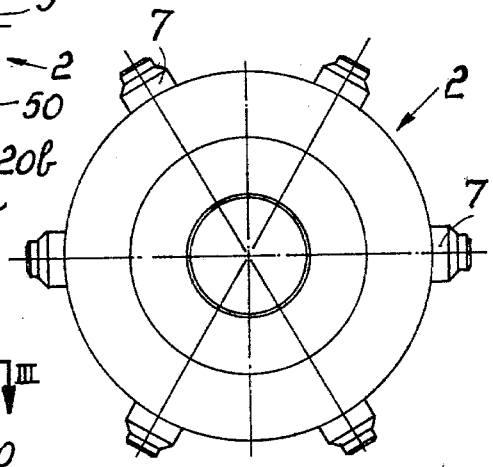
FIG. 2 is a view taken along the line II—II of FIG. 1.
Figure 3:
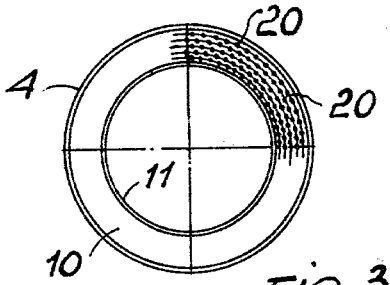
FIG. 3 is a schematical sectional view taken along the line III—III of FIG. 1.
Figure 4:
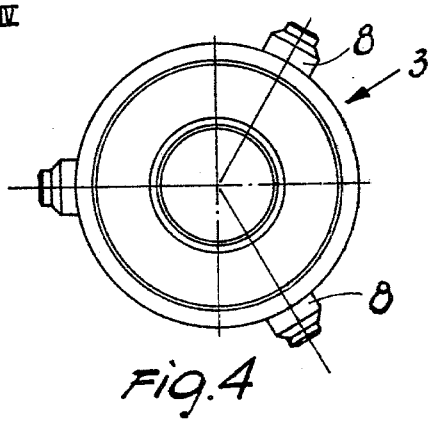
FIG. 4 is a sectional view taken along the line IV—IV of FIG. 1.
Figure 5:
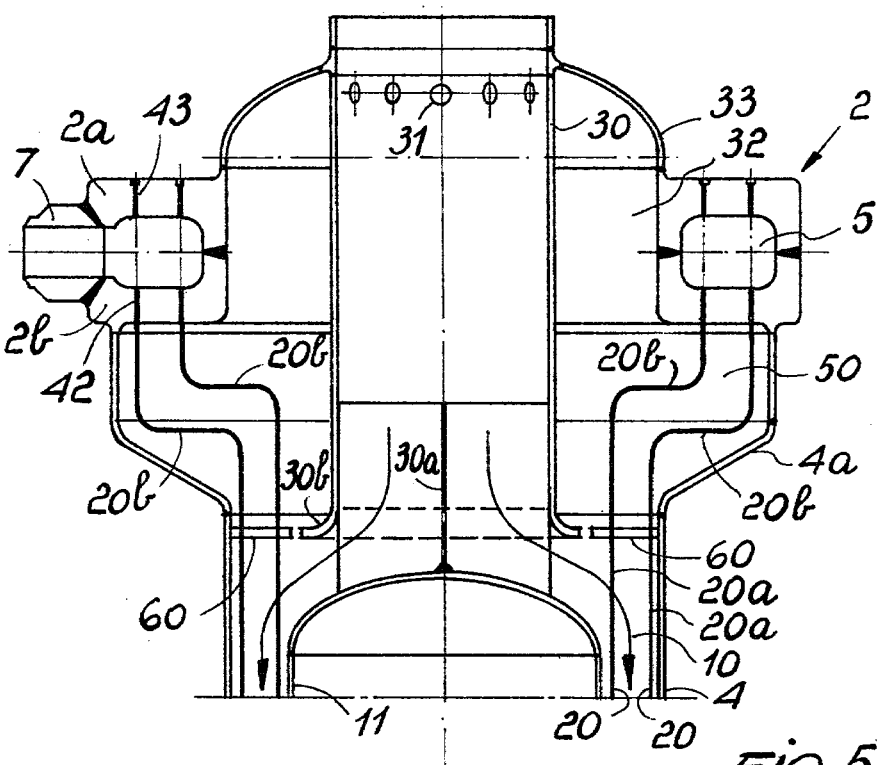
FIG. 5 is a schematical enlarged scale detail view of the upper tube plate in the embodiment of FIG. 1.
Figure 6:
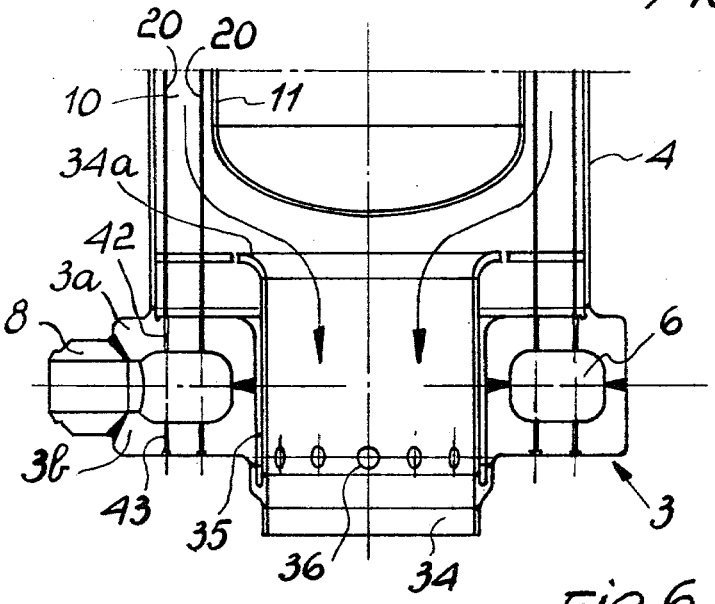
FIG. 6 shows schematically, to an enlarged scale, a detail of the lower tube plate in the embodiment of FIG. 1.
Figure 8:
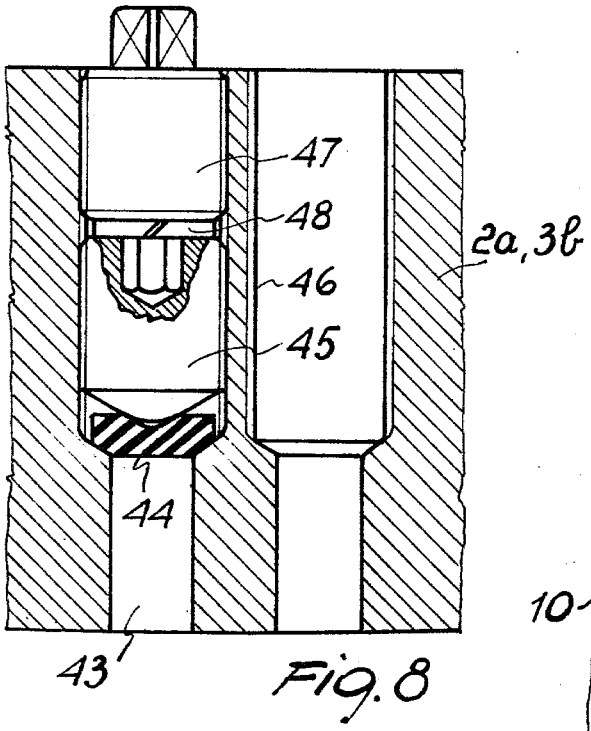
FIG. 8 is a sectional detail view of the safety plugs provided in the bores formed through the tube plates at the tubes for both the embodiments of this invention.
Figure 7:
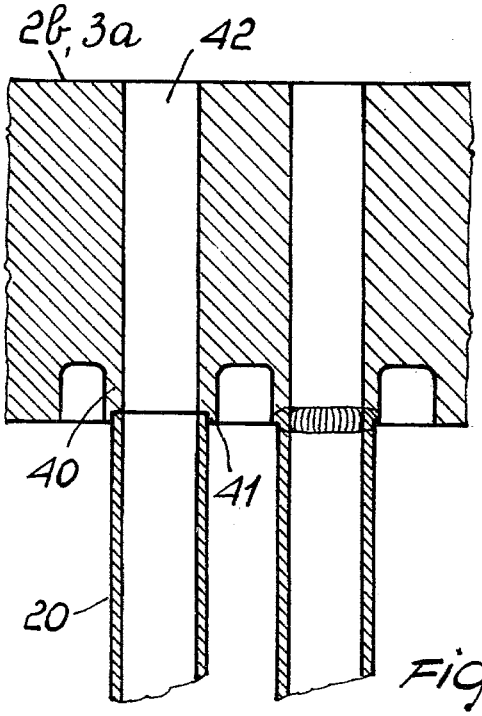
FIG. 7 shows schematically and in section the weldment areas of the tubes in the tube nest to the tube plates for both the embodiments.

With reference to FIGS. 1 to 9 of the drawings, the counterflow heat exchanger 1 having two fixed tube plates, according to a first embodiment of this invention, will be presently described, which comprises an upper tube plate, generally indicated at 2, and a lower tube plate, generally indicated at 3. Such tube plates, 2 and 3, are of annular configuration and are arranged to face each other concentrically from a distance apart; moreover, the plate 3 has of preference a smaller diameter than the plate 2.

The tube plates 2,3 are united together by an outer casing or shroud 4 of substantially cylindrical shape, which may include, if desired, a thermal expansion joint, not shown, at a middle portion of its length. Said shroud 4 is welded to the plates 2 and 3 prior to the introduction of the tube nest, such that it becomes possible to thoroughly inspect the completed weldments as well as to reweld them reversely, to accomplish a fully satisfactory construction.

More in detail, the plates 2 and 3 define therewithin, respectively, an upper annular chamber 5 and lower annular chamber 6. The upper tube plate 2 comprises a top body 2*a* which is welded to a bottom body 2*b*, thus defining together the cited chamber 5 which serves practically as the outlet header for the secondary fluid and is provided with a plurality of radially arranged outlet fittings, indicated at 7, which are uniformly distributed with respect to the annular header upper tube plate 2.

The lower tube plate 3 is similarly composed of a top body, indicated at 3*a*, and bottom body, indicated at 3*b*, which are welded to each other to define said lower annular chamber, which chamber serves in practice as the secondary fluid inlet header and communicates to a plurality of inlet fittings 8, also uniformly distributed.

The chambers 5 and 6 are interconnected by a tube nest which is accommodated within an annular interspace 10 defined between said shroud 4 and an inner jacket 11 which is arranged coaxial with the shroud 4 and has a substantially cylindrical shape with closed top and bottom, it being connected to the other parts of the exchanger structure only at its top end, thus allowing for expansion in a free manner.

Said tube nest, and here resides a fundamental feature of the invention, comprise a plurality of uniformly distributed tubes, indicated at 20, which have a rectilinear portion 20*a*, located inside said interspace 10, and at one end, namely the end next to the plate 2, a portion 20*b* which is bent outwardly S-like. Said S-like bent portions 20*b* may lay, for instance, on a radial plane with respect to the longitudinal axis of the heat exchanger, and are inserted with their free ends into the upper tube plate 2, which for this very reason has a larger diameter than the lower plate 3.

Before discussing in detail how the tubes 20 of the tube nest are connected to the tube plates 2 and 3, it should be noted that from the jacket 11, with the aid of rubs such as indicated at 30*a*, there extends upwardly a primary fluid inlet duct 30, which protrudes inside the ring forming the tube plate 2 such as to create a thermal shield capable of protecting the plate itself from sharp temperature variations in the primary fluid; the duct 30 has at its bottom or lower end 30*b* a flare-out which defines, in cooperation with the top closure member of the jacket 11, a peripheral passageway for a uniform distribution of the primary fluid flow at the thermal exchange zone, as indicated by the arrows, and is provided with plural openings 31 adapted for providing a limited flow of primary fluid through the space portion 32 included between the tube plate 2, duct 30, and bottom 33 connected thereto.

The outlet duct 34 for the primary fluid is connected to the tube plate 3, and penetrates the ring defined thereby to form an interspace 35 which acts as a thermal shield and wherethrough a limited flow of primary fluid is allowed for by the openings 36; the upper or top end 34*a* of the duct 34 is flared to facilitate the flow of primary fluid in the direction of the arrows, thus achieving optimal conveyance conditions for the fluid to the outlet duct.

The connection of the tubes 20 to the respective plates 2 and 3 is accomplished by welding in conformity with the IBW (Internal Bore Welding) known procedure of the TIG (Tungsten Inert Gas) type. The fundamental feature is that with the structure just described the ends of the tubes 20 can be connected both to the upper plate 2 and to the lower plate 3 in a quite similar manner, because it is no longer necessary, contrary to the known designs, to provide an oversize bore, i.e. a bore having a diameter substantially equal to the outside diameter of the tube, but both the upper and lower tube plates can be provided with spigots 40 having an annular seat 41 wherein the ends of the tubes 20 are inserted.

More specifically, the cited spigots, or spigot members, 40 are formed on bodies 2*b* and 3*a* of the respective plates 2 and 3. At each spigot 40, there is formed a hole 42 which places the tube 20 into communication with the inside of the respective annular chamber, 5 or 6, which has an inside diameter substantially equal to the inside diameter of each tube 20.

Furthermore, at each hole 42 formed in the body 2*b* or 3*a*, there is provided in the body 2*a* or 3*b* a through hole 43 arranged to lay in alignment with the hole 42 and having the function of allowing the introduction of welding torches therethrough to execute the welding of the tube 20 to its respective spigot 40.

Each through hole 43 is removably closed by a sealing member 44 which is pressed by a threaded pin 45 engaging a threaded portion 46 provided at the free end of the through hole 43, wherewith a locking or safety threaded pin 47 also engages with the interposition of a lockwasher 48.

This embodiment affords the possibility of removing the closures of the various through holes 43 to gain access for periodical inspection of the tubes and of the weldment areas.

It will be apparent from the foregoing that a fundamental feature of the heat exchanger according to the invention resides in that, by providing substantially rectilinear tubes at the thermal exchange zone but having an S-like bent end portion, it is possible to perform in a quite similar manner and with the best possible technique the connection weldments to both the lower and upper plates, thus achieving the advantage of uniform and easily inspected weldments with the X-ray method.

A no less important feature is that by providing the tubes with an S-like bent termination, any expansion taking place in the tubes can be accommodated, and above all any expansion differential i.e. different rates of expansion among the tubes as due to possible differences in thermal distribution, are freely discharged without such expansion rates inducing stresses which may stress the weldment areas.

Moreover, by providing tubes with an S-like portion which are all butt welded to the tube plates, the advantage is secured that the welded area are only moderately stressed and substantially so only is compression or tension, i.e. a stress which can be more easily tolerated by the weldment without inducing any technically undesirable stresses.

It should be further added to the foregoing that each tube 20 has its end welded to the body 3*a* of the tube plate 3 spaced apart from the point of communication between the annular chamber 6 and the hole 42, which acquires considerable importance in view of the obvious fact that the fluid streamlines, in changing their direction by reason of their passing from the annular chamber 6 to the holes 42 of connection to the tubes 20, tend to create areas of cavitation where they change in direction, which areas of cavitation would result in premature damage to the weldments should they happen to occur at the weldments themselves. By contrast, in the embodiment described, it will be apparent that the weldment area of the free end of each tube 20 is away from the connection area between the holes 42 and annular chamber 6; this ensures that at the weldment area the fluid streamlines are already channeled along their path, thus preventing undesired erosion of the weldment areas between the tubes and lower tube plate.

Another feature of the invention is that the cited S-like bent portion is arranged at an annular area or zone 50 defined by the duct 30 and connection 4*a* of the shroud 4 to the plate 2, which in turn defines practically one portion of the primary fluid circuit wherein the fluid is virtually stagnant and therefore induces no vibratory condition in the S-like bent portions 20*b* of the tubes 20.

Also worthy of attention is that feature of the invention which resides in the utilization of low mass and thickness dimension forgings in the construction of the tube plates, which results in quite obvious advantages for the expert.

The invention is also characterized by the axial lay of the primary fluid inlet and outlet, which simplifies the installation, reduces the costs, ensures an optimal fluid dynamics distribution of the fluid, and easy draining in case of failure.

Figure 9:
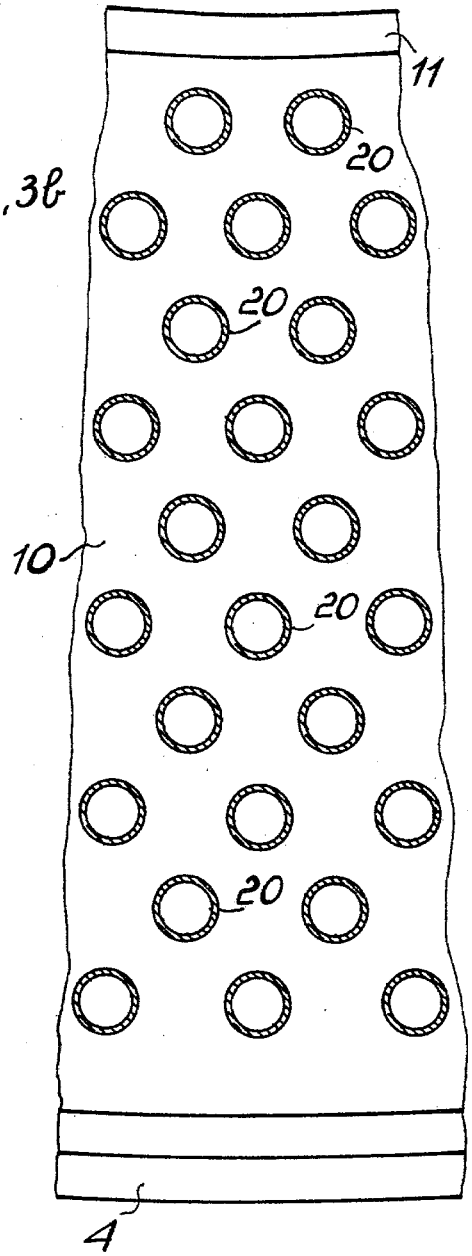
FIG. 9 is an enlarged scale cross-sectional view of part of the tube nest for both the embodiments of the invention.

In conclusion, it is pointed out that in the drawing figures, for simplicity and clarity of illustration, only those tubes of the tube nest are shown which happen to be the outermost and innermost ones, defining in practice the location of the tubes 20; in fact, as shown more clearly in FIG. 9, there is provided a plurality of tubes 20 which are uniformly distributed with respect to one another and accommodated in the annular zone or area 10.

The heat exchanger according to this invention is operated in the following manner. When the heat exchanger is utilized in counterflow, the primary fluid, which has for instance a temperature around 500° C. and a pressure of 10 metric atmospheres, is admitted to the inside of the exchanger through the inlet duct 30, such as to envelop the tubes 20 of the tube nest which are arranged in the interspace 10; the primary fluid flows lengthwise along the interspace 10 to deliver heat to each tube 20, and is then led to the outlet duct 34. At the same time, the secondary fluid, i.e. the fluid to be heated, is admitted into the lower annular chamber 6 through the inlet fittings 8 and conveyed to the tubes 20 after flowing, as mentioned, through the rectilinear portion 20*a*, where the thermal exchange takes place, and then through the S-like portion 20*b*.

Upon reaching the end of the S-like portion 20*b*, the secondary fluid is admitted into the upper annular chamnber 5, wherefrom it is removed, through the outlet fittings 7, out of the heat exchanger.

Obviously, even if in the foregoing description has been referred to a counterflow type of operation with respect to the primary and secondary fluids, nothing will change in principle when the exchanger is used in the uniflow mode, as nothing will change if the counterflow operation is carried into effect with the direction of flow of both the primary and secondary fluids reversed.

It will be appreciated from the foregoing that the invention achieves its objects, and in particular the fact is underlined that the structure according to the invention affords a construction that can be accomplished through a simple procedure and such as to permit easy inspection of the weldments. After assembling the tube plates 2 and 3 to the shroud 4, and without the inner jacket 11 and its integral duct 30, those tubes 20 are first inserted from above through the diaphragms 60 which lay closest to the shroud 4, leaving the S-like portion thereof towards the inside in order to provide a comfortable passage through the annular space portion included within the plate 2, each such tube being successively rotated about its own axis such as to bring said S-like portion 20*b* to the position shown in the drawings, which permits connection by application of a slight deflection, to the holes 42 through the plate 2; after welding said tubes in the manner described above, without changing the position of the exchanger, it will be easy to proceed with visual and X-ray inspections of the completed weldments.

The following tubes are mounted sequentially from the shroud 4 towards the inside, in order to always have the weld points accessible, and finally the outlet duct 34 is mounted along with the jacket 11 and duct 30 rigid therewith.

It will be appreciated that the S-like bent portions 20*b* are suitably offset, for the various tubes, in the vertical direction, in order to permit said assembling sequence.

Lastly, attention is drawn on the fact that by providing the plate 2, as shown in the drawings, with a larger inside diameter than the maximum diameter through the centers of the holes in the diaphragms 60 for the insertion of the tubes therethrough, said insertion being carried out in a very convenient way, although it would also be possible, by simply flexing the tubes somewhat, to effect it even if the inside diameter of the plate 2 is smaller than the maximum diameter through the centers of the holes.

FIG. 10 shows another embodiment of the invention, wherein the S-like bent portions 20*b* of the tubes 20 which are inserted through the interspace 10 included between the shroud 4 and inner jacket 11 are facing the inside; in this embodient, the upper plate 2 has the inlet duct 30 connected thereto in a manner similar to those described with referehce to the first embodiment for connecting the outlet duct 34 to the plate 3, while the outlet duct 34 is connected to the jacket 11 and inserted into the annular hole provided by the plate 3 in a manner similar to those described with reference to the duct 30 of the first embodiment.

The assembling is carried out by inserting the tubes 20 between the assembled plates 2 and 3 and in the presence of the jacket 11, prior to mounting the shroud 4, understandably by starting with the innermost diameter tubes.

The invention as described is susceptible to many modifications and variations, all of which are intended to fall within the scope of the instant inventive concept. In particular, the upper tube plate may comprise, in the embodiment of FIG. 10, a forging which defines therewithin a cylindrical rather than annular space portion, an ordinary heading being provided in such a case for the primary fluid inlet.

It should be added to the above that nothing will change in principle when the heat exchanger is positioned upside down, i.e. rotated by 180° with respect to the illustration in the drawings, whether the fluid flows are inverted or not; obviously, with this upside down arrangement, the plate 2, which was previously termed the upper one, will be at a lower level with respect to the plate 3, which was previously the lower one. It should be noted, moreover, that the operation remains unvaried from what has been described hereinabove.

Furthermore, all of the details may be replaced with other technically equivalent elements.

In practicing the invention, the materials employed as well as the shape and dimensions may be any ones to suit individual applicational requirements.

I claim:

1. A heat exchanger comprising an upper tube plate and a lower tube plate arranged to face each other in parallel and coaxial relationship and having different mean diameters of the bored areas, an inner jacket and an outer shroud coaxial therewith and with said annular tube plates and attached to said tube plates and defining an annular interspace therebetween, a tube nest extending between said upper and lower tube plates and including a plurality of tubes, said tubes being connected to said tube plates and distributed substantially in a polar symmetry arrangement and having a rectilinear portion and at one end an S-like bent portion, the rectilinear portion of said tube nest defining a substantial thermal exchange zone enclosed with substantially uniform distribution within said annular interspace and wherein said S-like bent end of said tubes lays in a substantially radial plane with respect to the heat exchanger longitudinal axis.

2. A heat exchanger according to claim 1, characterized in that the outside diameter of the annular body making up the plate connected to the S-like inwardly bent portions is approximately equal to, preferably slightly smaller than, the minimum intercenter diameter of the bores for connecting the tubes on the other plate, such as to make for a convenient insertion of said tubes.

3. A heat exchanger according to claim 1, characterized in that said S-like bent portion of said tubes in said tube nest is offset towards the heat exchanger inside.

4. A heat exchanger according to claim 3, characterized in that the free end of said S-like bent portion of said tubes is connected to that one of said tube plates hving the smaller mean diameter of the bored area.

5. A heat exchanger according to claim 1, wherein said inner jacket and said outer shroud define said annular interspace therebetween and wherein said upper and said lower tube plates comprise one tube plate having a larger diameter and another tube plate having a smaller diameter than that of said one tube plate and wherein said upper and lower tube plates are both made up of an annular body defining an annular space portion therebetween and having a bored area of annulus configuration the bores whereof are distributed in a substantially uniform manner, the lay of said bores being substantially polar, in each of said tube plates said annular body defining therewithin an annular chamber and within said annular space portion means defining a primary fluid inlet and respectively axial outlet, said annular body including fittings for conveying the secondary fluid.

6. A heat exchanger according to claim 5, characterized in that one of said tube plates comprises said annular body.

7. A heat exchanger according to claim 5, wherein said inner jacket has a closure member and wherein said means comprise an axial primary fluid inlet or outlet duct, said axial duct being connected to said inner jacket and included in the annular space portion defined by said one tube plate having the larger diameter, and further comprising a connection cap for connection to said tube plate and with openings therein, said cap defining an annular zone wherein the primary fluid is substantially stagnant, an edge of said duct facing said inner jacket being curled up such as to define, in cooperation with said closure member of said inner jacket, a peripheral passageway for the uniform distribution of the primary fluid flow.

8. A heat exchanger according to claim 5, wherein said inner jacket has a closure member and wherein said means comprise an axial primary fluid or outlet duct, said axial duct being connected to said another tube plate having the smaller diameter, and having openings therein, such as to define, in cooperation therewith, an annular zone where in the primary fluid is substantially stagnant, an edge of said duct facing said inner jacket being curled up such as to define, in cooperation with the closure member of said inner jacket, a peripheral passageway for the uniform distribution of the primary fluid flow.

* * * * *